United States Patent [19]

Nelson

[11] Patent Number: 4,679,023

[45] Date of Patent: Jul. 7, 1987

[54] OVER-TEMPERATURE CONTROL FOR A THERMOSTAT

[75] Inventor: Marvin D. Nelson, St. Louis Park, Minn.

[73] Assignee: Honeywell Inc., Minneapolis, Minn.

[21] Appl. No.: 896,351

[22] Filed: Aug. 14, 1986

[51] Int. Cl.[4] ..... H01H 61/08; H01H 71/14

[52] U.S. Cl. ..... 337/140; 337/96; 337/354

[58] Field of Search ..... 337/140, 354, 96

[56] References Cited

U.S. PATENT DOCUMENTS

| | | | |
|---|---|---|---|
| 3,176,099 | 3/1965 | Bergsma . | |
| 3,466,449 | 9/1969 | Ellenberger . | |
| 3,594,675 | 7/1971 | Willson . | |
| 3,634,803 | 1/1972 | Willson et al. . | |
| 3,872,415 | 3/1975 | Clarke | 337/140 |
| 4,517,543 | 5/1985 | Brubaker | 337/140 |
| 4,520,336 | 5/1985 | Hastings et al. . | |
| 4,538,201 | 8/1985 | Wuyts et al. . | |
| 4,568,904 | 2/1986 | Takahashi et al. | 337/140 |

*Primary Examiner*—Harold Broome

*Attorney, Agent, or Firm*—Mitchell J. Halista; Albin Medved

[57] ABSTRACT

An over-temperature control for a thermostat uses an electrical contact actuator of a memory metal having an ability to change its physical configuration at a transition temperature to a "memory" shape. The contact actuator is arranged to bear against a cantilevered leaf spring having electrical contacts at a free end of the spring while the other fixed end of the spring is connected to complete an electrical circuit through the spring. The spring is also actuated by a bi-metallic element to produce a normal temperature responsive operation of the thermostat. The memory material actuator is arranged to provide a flexing of the spring cantilever to move the free end contact between a first and a second electrical terminal when the memory material is exposed to a transition temperature allowing the actuator to assume its "memory" shape. The "memory" shape of the memory material is, thus, effective to propel the end of the leaf spring and the electrical contact carried thereby from a first position to a second position to produce an over-temperature response operation of the thermostat.

5 Claims, 3 Drawing Figures

OVER-TEMPERATURE CONTROL FOR A THERMOSTAT

BACKGROUND OF THE INVENTION

Field of the Invention

The present invention relates to thermostats. More specifically, the present invention is directed to a thermostat having an over-temperature control.

SUMMARY OF THE INVENTION

An object of the present invention is to provide an improved thermostat having an over-temperature control.

In accomplishing this and other objects, there has been provided, in accordance with the present invention, a thermostat having electrical contact carried by a free end of a cantilevered leaf spring having an unactuated first position, a heat responsive means including a memory material element having a first shape below a predetermined temperature and a second shape above the predetermined temperature and means connecting the heat responsive means to the spring means to enable the heat responsive means to urge the spring means into a predetermined second position above the predetermined temperature.

BRIEF DESCRIPTION OF THE DRAWINGS

A better understanding of the present invention may be had when the following detailed description is read in connection with the accompanying drawings in which.

DESCRIPTION OF THE PREFERRED EMBODIMENT

Detailed Description

Figure 1:
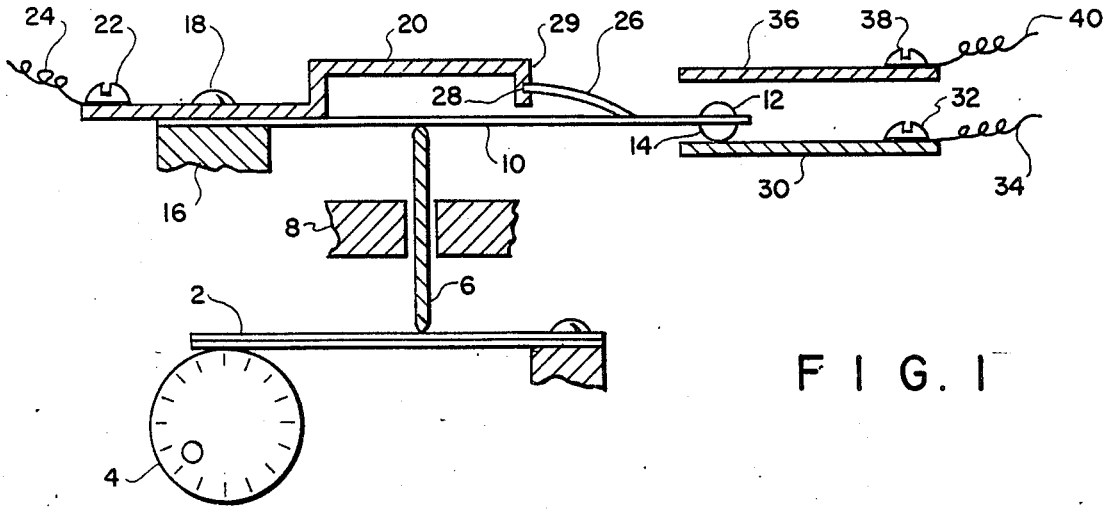
FIG. 1 is a pictorial illustration of a functional pictorial representation of a thermostat mechanism embodying the present invention.

Referring to FIG. 1 in more detail, there is shown a thermostat mechanism having a bi-metallic element 2 for sensing the temperature of an environment to be controlled by the thermostat. The bi-metallic element 2 has an adjustable operating range which is preset by a temperature cam 4 in a conventional fashion. The bi-metallic element 2 is arranged to contact one end of a plunger 6 which is slideably retained in a support 8. The other end of the plunger 6 is positioned to contact a cantilevered leaf spring member 10. The leaf spring member 10 is arranged to carry an electrical contact pair 12,14 at a free end thereof. The other end of the leaf spring 10 is fastened to a support 16 by a rivet 18. A memory metal actuator member 20 in the form of a preshaped plate is also captured at a point intermediate its ends beneath the rivet 18. One end of the actuator 20 provides an electrical contact via a first threaded wire retaining screw 22 for capturing the end of a wire 24 on the actuator member 20. The other end of the memory metal member 20 has a hollow box cross-section and is arranged to contact a portion of the leaf spring 10 extending from the spring 10 as a curved spring extension

Figure 3:
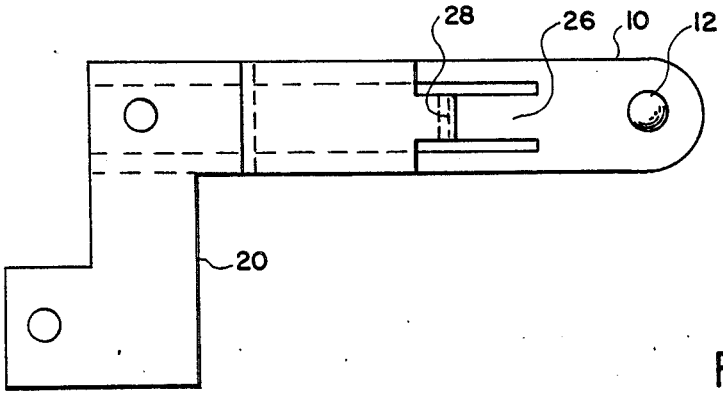

26 The end of the finger 26 is positioned in a groove 28 in a side wall 29 of the box end of the member 20. A top view of the combination of the spring 10 and actuator member 20 is shown in FIG. 3 to clarify their interrelationship.

The material of the member 20 is an alloy having a "memory" capability, e.g., an alloy as discussed in U.S. Pat. Nos. 3,802,930; 3,832,243 and 3,748,108. An example of a suitable material is an aluminum and brass type of memory metal. Such materials can be preformed into a "preform" shape which is retained below a critical or threshold temperature. The critical temperature is arranged to be above the normal operation of the thermostat. At the critical temperature, the memory material returns to its original or "memory" shape.

An example of a memory material actuator is shown in U.S. Pat. No. 4,430,392 wherein the memory material is arranged to release a diaphragm puncturing barb above the critical temperature. In the structure of the present invention, the memory element 20 has a preformed shape which is effective to position the contact 14 in a first position and a "memory" shape wherein the spring 10 is repositioned by the memory element 20 vias the finger 26 to position the contact 12,14 in a second position. The contact 14 in the first position is arranged to provide an electrical connection between the wire 24 and screw 22 and a first electrical terminal strip 30 having a second threaded screw 32 at one end thereof for connecting the strip 30 to an electrical conductor 34. In the second position of the spring 10, the contact 14 is free of the first terminal strip 30, and the electrical contact 12 is brought into contact with a second electrical strip 36 to provide an electrical connection to a third screw member 38 and an electrical conductor 40 captured thereby.

Figure 2:
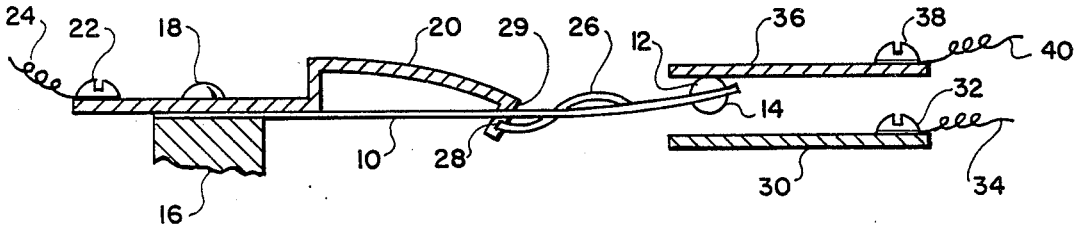
FIG. 2 is a pictorial illustration of a portion of the thermostat mechanism shown in FIG. 1 with the mechanism in an over-temperature condition and FIG. 3 is a top view of a memory metal element and leaf spring combination used in the thermostat shown in FIGS. 1 and 2.

In operation, the memory material actuator 20 is positioned as shown in FIG. 1 during a normal or below critical temperature operation of the thermostat. In this arrangement, the bi-metallic element 2 is effective to operate the spring 12 to displace the contacts 12,14. To provide the over-temperature control for the thermostat the memory element 20 is arranged to revert to its "memory" shape at a suitable transition temperature, e.g., 100° F. At this transition temperature, the memory element 20 is effective to shift or reposition the location of the spring 10 via the spring extension 26 as shown in FIG. 2. Specifically, the memory element 20 produces a shift in the position of the groove 28, i.e., an anchor point for the extension 26, to produce a movement of the spring 10 from a first position to a second position. This movement of the spring 10 is, in turn, effective to transfer the contacts 12,14 from the first strip 30 in the first position to the second strip 36 in the second position. The opening and closing of the electrical connections provided by the movement of the spring 10 and the contacts 12,14 is used to provide an appropriate control action, e.g., to interrupt the heating of the enclosure being monitored by the thermostat. Such a design provides a low cost and integral over-temperature control for the thermostat without the need for an external control.

Accordingly, it may be seen, that there has been provided, in accordance with the present invention an improved thermostat having an over-temperature control.

The embodiments of the present invention in which an exclusive property or privilege is claimed are defined as follows:

1. A thermostat comprising a cantilevered spring means having an unactuated first position carrying electrical contacts at a free end thereof, a heat responsive means including a memory material element having a first shape below a predetermined critical temperature and a second shape above said temperature, means connecting said heat responsive means to said spring means to enable said heat responsive means to urge said spring means into a predetermined second position above said temperature to transfer the electrical contacts from a first position to a second position and bi-metallic temperature responsive means connected to said spring means for transferring said electrical contacts on said spring means between said first and second positions independently of said heat responsive means.

2. A thermostat as set forth in claim 1 and further including first and second stationary electrical contacts, said first stationary contact engaging said electrical contacts on said spring means in said first position and said second stationary contacts engaging said contacts on said spring means in said second position.

3. A thermostat as set forth in claim 1 wherein said bimetallic temperature responsive means includes a bimetallic lever means and a guided pin extending between said bimetallic lever and said spring means.

4. A thermostat as set forth in claim 1 wherein said memory material element is an aluminum and brass alloy.

5. A thermostat as set forth in claim 1 wherein said means connecting said heat responsive means to said spring means includes an extension of said spring means forming a flexible lever between said heat responsive means and said spring means.

* * * * *